US005664642A

United States Patent [19]

Williams

[11] Patent Number: 5,664,642

[45] Date of Patent: Sep. 9, 1997

[54] FIRE EVACUATION KIT

[76] Inventor: Bernard Williams, 104 Schroder, Yonkers, N.Y. 10705

[21] Appl. No.: 701,649

[22] Filed: Aug. 26, 1996

[51] Int. Cl.[6] ..... E06C 9/14

[52] U.S. Cl. ..... 182/70; 182/151; 182/7; 182/8

[58] Field of Search ..... 182/70, 74, 73, 182/71, 3, 6, 7, 8, 151

[56] References Cited

U.S. PATENT DOCUMENTS

| | | | |
|---|---|---|---|
| 279,186 | 6/1883 | Ricker | 182/70 |
| 3,459,276 | 8/1969 | Fuse | 182/72 |
| 3,692,145 | 9/1972 | Banner | 182/70 |
| 3,701,395 | 10/1972 | Theobald | 182/3 |

FOREIGN PATENT DOCUMENTS

| | | | |
|---|---|---|---|
| 2580182 | 10/1986 | France | 182/7 |
| 2191560 | 12/1987 | United Kingdom | 182/3 |

*Primary Examiner*—Alvin C. Chin-Shue

[57] ABSTRACT

A fire evacuation kit including a housing securable within a residence beneath a window thereof. A rope ladder is secured to an inner surface of the housing so that the housing can be opened to allow the ladder to be extended out through the window to a position where a lower end of the ladder is adjacent to a ground area.

9 Claims, 3 Drawing Sheets

FIRE EVACUATION KIT

BACKGROUND OF THE INVENTION

1. Field of the Invention

The present invention relates to a fire evacuation kit and more particularly pertains to aiding individuals in escaping unharmed from a fire within a residence with a fire evacuation kit.

2. Description of the Prior Art

The use of fire escape device is known in the prior art. More specifically, fire escape device heretofore devised and utilized for the purpose of escaping a fire in a building are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,020,633 to Rangel discloses an emergency escape device.

U.S. Pat. No. 4,503,933 to O'Neil discloses a building evacuation device.

U.S. Pat. No. Des. 350,416 to Doiron discloses the ornamental design for a fire escape kit for building emergencies.

U.S. Pat. No. 4,235,306 to Ross et al. discloses an emergency escape device.

U.S. Pat. No. 4,127,184 to Strohmeyer discloses a combination flower box and fire escape.

U.S. Pat. No. 4,249,345 to Littleton discloses a releasable window guard.

While these devices fulfill their respective, particular objective and requirements, the aforementioned patents do not describe a fire evacuation kit for aiding individuals in escaping unharmed from a fire within a residence.

In this respect, the fire evacuation kit according to the present invention substantially departs from the conventional concepts and designs of the prior art, and in doing so provides an apparatus primarily developed for the purpose of aiding individuals in escaping unharmed from a fire within a residence.

Therefore, it can be appreciated that there exists a continuing need for new and improved fire evacuation kit which can be used for aiding individuals in escaping unharmed from a fire within a residence. In this regard, the present invention substantially fulfills this need.

SUMMARY OF THE INVENTION

In the view of the foregoing disadvantages inherent in the known types of fire escape device now present in the prior art, the present invention provides an improved fire evacuation kit. As such, the general purpose of the present invention, which will be described subsequently in greater detail, is to provide a new and improved fire evacuation kit and method which has all the advantages of the prior art and none of the disadvantages.

To attain this, the present invention essentially comprises a housing having a generally rectangular configuration. The housing has an open upper end, a closed lower end and a peripheral wall extending therebetween. The housing includes a lid hingedly secured to the open upper end thereof. The lid is of a clear plastic material. The lid has a handle disposed on an upper end thereof. The housing is securable within a residence beneath a window thereof. The device includes a ladder comprised of a pair of elongated ropes. A plurality of step bars extend between the ropes in a spaced relationship. Upper ends of the ropes are secured to an inner surface of the closed lower end of the housing. The device includes a pair of cables each having looped upper and lower ends. The device includes four spring-clips. Two of the spring-clips couple with the upper looped ends of the pair of cables for coupling with an upper end of the ladder. Two of the spring-clips couple with the looped lower ends of the pair of cables. A fire extinguisher is positionable within the housing. A flashlight is positionable within the housing. A respiration mask is positionable within the housing. The device includes a safety harness comprised of a pair of elongated torso straps joined together at lower ends thereof. A waist band is secured to and extends around the pair of elongated torso straps. A pair of rings are coupled with upper ends of the torso straps. The pair of rings couple with the two spring-clips on the looped lower ends of the pair of cables.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fire evacuation kit which has all the advantages of the prior art fire escape device and none of the disadvantages.

It is another object of the present invention to provide a new and improved fire evacuation kit which may be easily and efficiently manufactured and marketed.

It is a further object of the present invention to provide a new and improved fire evacuation kit which is of durable and reliable construction.

An even further object of the present invention is to provide a new and improved fire evacuation kit which is susceptible of a low cost of manufacture with regard to both materials and labor, and which accordingly is then susceptible of low prices of sale to the consuming public, thereby making such a fire evacuation kit economically available to the buying public.

Even still another object of the present invention is to provide a new and improved fire evacuation kit for aiding individuals in escaping unharmed from a fire within a residence.

Lastly, it is an object of the present invention to provide a new and improved fire evacuation kit including a housing securable within a residence beneath a window thereof. A rope ladder is secured to an inner surface of the housing so that the housing can be opened to allow the ladder to be extended out through the window to a position where a lower end of the ladder is adjacent to a ground area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

With reference now to the drawings, and in particular, to FIGS. 1–8 thereof, the preferred embodiment of the new and improved fire evacuation kit embodying the principles and concepts of the present invention and generally designated by the reference number 10 will be described.

Specifically, it will be noted in the various Figures that the device relates to a fire evacuation kit for aiding individuals in escaping unharmed from a fire within a residence. In its broadest context, the device consists of a housing, a ladder, pair of cables, four spring-clips, a fire extinguisher, a flashlight, a respiration mask and a safety harness. Such components are individually configured and correlated with respect to each other so as to attain the desired objective.

Figure 1:
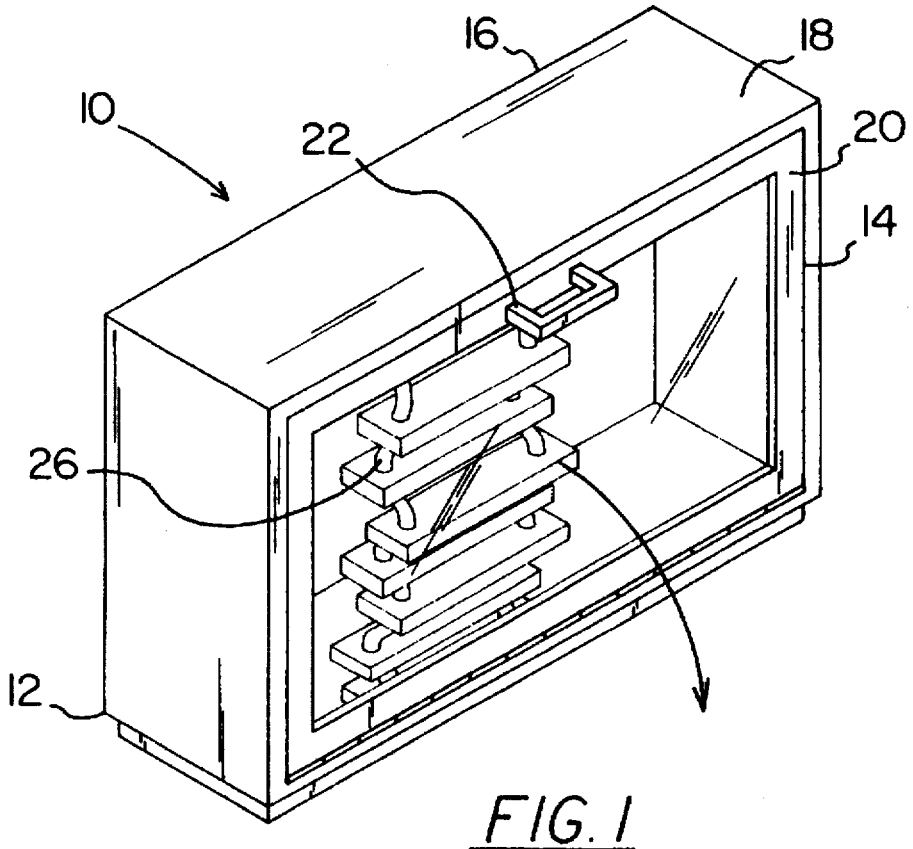
FIG. 1 is a perspective view of the preferred embodiment of the fire evacuation kit constructed in accordance with the principles of the present invention.

The device 10 includes a housing 12 having a generally rectangular configuration as illustrated in FIG. 1. The housing 12 has an open upper end 14, a closed lower end 16 and a peripheral wall 18 extending therebetween. The housing 12 includes a lid 20 hingedly secured to the open upper end 14 thereof. The lid 20 is secured to a lower end of the open upper end 14. The lid 20 is of a clear plastic material. This allows for contents within the housing 12 to be viewed without having to lift the lid 20. The lid 20 has a handle 22 disposed on an upper end thereof. The housing 12 is securable within a residence beneath a window thereof. Pulling on the handle 22 will allow for the lid 20 to open downwardly to expose the contents within the housing 12. The housing 12 should be secured by a window where there is easy access to a ground surface.

Figure 4:
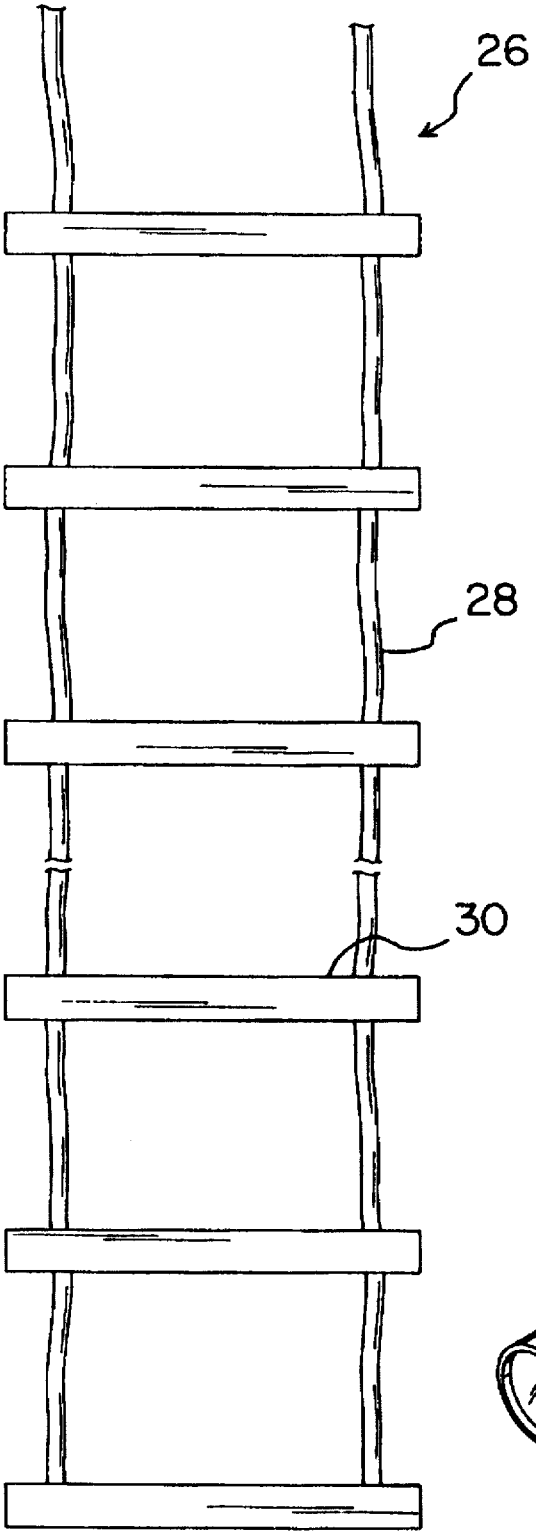
FIG. 4 is a front sectional view of the ladder in an extended orientation.

FIG. 1 and FIG. 4 illustrate a ladder 26 comprised of a pair of elongated ropes 28. A plurality of step bars 30 extend between the ropes 28 in a spaced relationship. Upper ends of the ropes 28 are secured to an inner surface of the closed lower end 16 of the housing 12. Once a fire or other emergency occurs, the lid 20 is opened and the ladder 26 is extended out through the window to allow a person to climb down the ladder 26 to a safe location away from the fire or other emergency.

Figure 2:
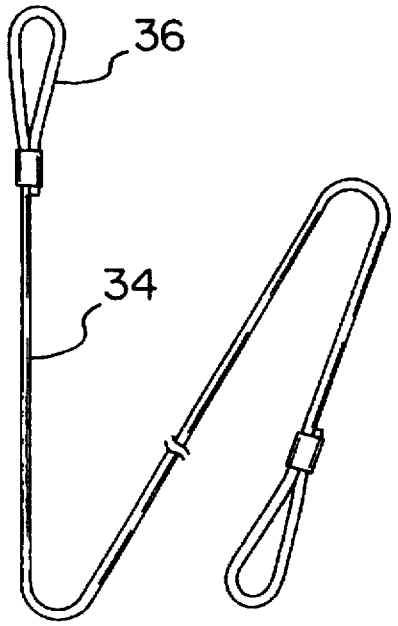
FIG. 2 is an isolated view of the cable of the present invention.

The device 10 includes a pair of cables 34 each having looped upper and lower ends 36. A single cable 34 is illustrated in FIG. 2.

Figure 3:
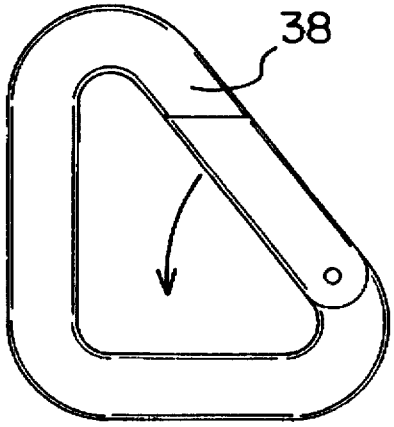
FIG. 3 is an isolated view of the spring-clip of the present invention.

FIG. 3 illustrates an example of one of four spring-clips 38. Two of the spring-clips 38 couple with the upper looped ends 36 of the pair of cables 34 for coupling with an upper end of the ladder 26. Two of the spring-clips 38 couple with the looped lower ends 36 of the pair of cables 34.

Figure 5:
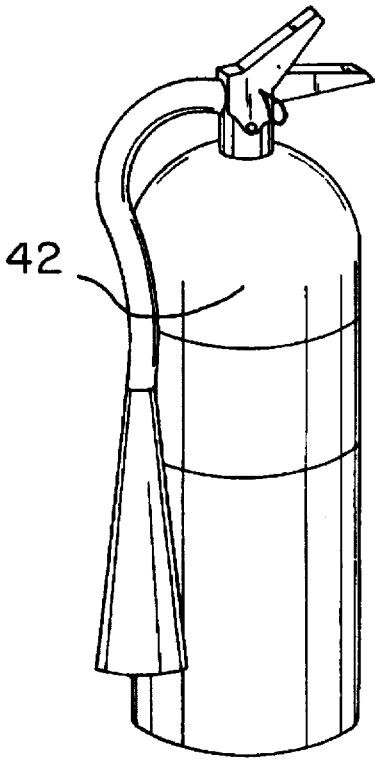
FIG. 5 is an isolated view of the fire extinguisher of the present invention.

A fire extinguisher 42, as illustrated in FIG. 5, is positionable within the housing 12. The fire extinguisher 42 will allow a person trapped in a fire to temporarily battle the fire to enable escape from the residence. The fire extinguisher 42 is of a design known in the art. The only dimensional requirement of the fire extinguisher 42 is to be able to fit within the housing 12.

Figure 6:
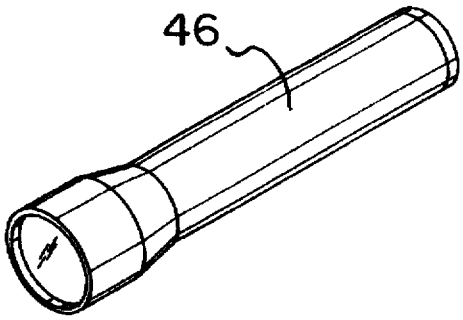
FIG. 6 is an isolated view of the flashlight of the present invention.

A flashlight 46, as illustrated in FIG. 6, is positionable within the housing 12. The flashlight 46 will be provided in case electrical power is lost within the residence or if the time of day is night so as to allow a person to see at night. The flashlight 46 is of a design known in the art. The only dimensional requirement of the flashlight 46 is to be able to fit within the housing 12.

Figure 7:
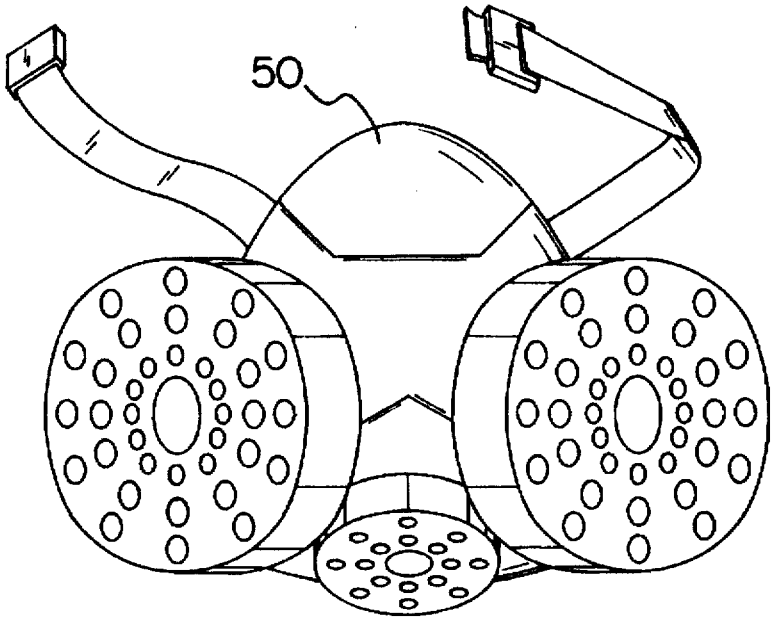
FIG. 7 is an isolated view of the respiration mask of the present invention.

A respiration mask 50, as illustrated in FIG. 7, is positionable within the housing 12. The respiration mask 50 is provided to aid a person in breathing in the event of a fire. The respiration mask 50 is of a design known in the art. The only dimensional requirement of the respiration mask 50 is to be able to fit within the housing 12.

Figure 8:
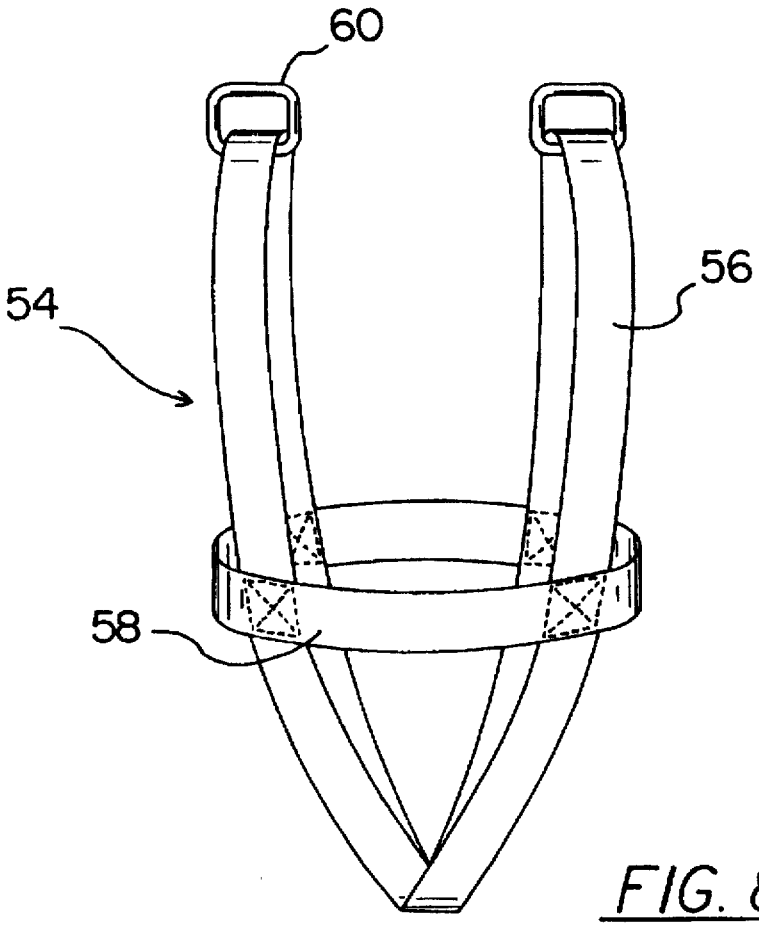
FIG. 8 is an isolated view of the harness of the present invention.

The device 10 includes a safety harness 54, as illustrated in FIG. 8, comprised of a pair of elongated torso straps 56 joined together at lower ends thereof. A waist band 58 is secured to and extends around the pair of elongated torso straps 56. A pair of rings 60 are coupled with upper ends of the torso straps 56. The pair of rings 60 couple with the two spring-clips 38 on the looped lower ends 36 of the pair of cables 34. The safety harness 54 is placed on the person escaping the fire. The pair of cables 34 are then connected to the safety harness 54 and to the upper end of the ladder 26. This will allow the person to climb down the ladder 26 to safety with the added insurance that if they somehow slip off of the ladder 26, the safety harness 54 will prevent them from falling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A fire evacuation kit for aiding individuals in escaping unharmed from a fire within a residence comprising, in combination:

a housing having a generally rectangular configuration, the housing having an open upper end, a closed lower end and a peripheral wall extending therebetween, the housing including a lid hingedly secured to the open upper end thereof, the lid being of a clear plastic material, the lid having a handle disposed on an upper end thereof, the housing securable within a residence beneath a window thereof;

a ladder comprised of a pair of elongated ropes, a plurality of step bars extend between the ropes in a spaced relationship, upper ends of the ropes secured to an inner surface of the closed lower end of the housing;

a pair of cables each having looped upper and lower ends;

four spring-clips, two of the spring-clips coupling with the upper looped ends of the pair of cables and coupling with an upper end of the ladder, two of the spring-clips coupling with the looped lower ends of the pair of cables;

a fire extinguisher positionable within the housing;

a flashlight positionable within the housing;

a respiration mask positionable within the housing;

a safety harness comprised of a pair of elongated torso straps joined together at lower ends thereof, a waist band secured to and extends around the pair of elongated torso straps, a pair of rings coupled with upper ends of the torso straps, the pair of rings coupling with the two spring-clips on the looped lower ends of the pair of cables.

2. A fire evacuation kit comprising:

a housing securable within a residence beneath a window thereof;

a rope-ladder secured to an inner surface of the housing; a pair of cables each having looped upper and lower ends; four spring-clips, two of the spring-clips coupling with the upper loop ends of the pair of cables and coupling with an upper end of the ladder, two of the spring-clips coupling with the looped lower ends of the pair of cables; a safety harness comprised of a pair of elongated torso straps joined together at lower ends thereof, a waist band secured to and extends around the pair of elongated torso straps, a pair of rings coupled with upper ends of the torso straps, the pair of rings coupling with the two spring-clips on the looped lower ends of the pair of cables.

3. The fire evacuation kit as set forth in claim 2 and further including a fire extinguisher positionable within the housing.

4. The fire evacuation kit as set forth in claim 2 and further including a flashlight positionable within the housing.

5. The fire evacuation kit as set forth in claim 2 and further including a respiration mask positionable within the housing.

6. The fire evacuation kit as set forth in claim 2 wherein the housing having an open upper end, a closed lower end and a peripheral wall extending therebetween.

7. The fire evacuation kit as set forth in claim 6 wherein the housing including a lid hingedly secured to the open upper end thereof.

8. The fire evacuation kit as set forth in claim 7 wherein the lid being of a clear plastic material.

9. The fire evacuation kit as set forth in claim 8 wherein the lid having a handle disposed on an upper end thereof.

* * * * *